United States Patent [19]

Tuomi

[11] Patent Number: 4,905,475

[45] Date of Patent: Mar. 6, 1990

[54] PERSONAL COMFORT CONDITIONER

[76] Inventor: Donald Tuomi, 626 S. Kaspar Ave., Arlington Heights, Ill. 60005

[21] Appl. No.: 344,057

[22] Filed: Apr. 27, 1989

[51] Int. Cl.[4] ..... F25B 21/02

[52] U.S. Cl. ..... 62/3.3; 62/259.3

[58] Field of Search ..... 62/3.5, 259.3, 261, 62/325, 3.3

[56] References Cited

U.S. PATENT DOCUMENTS

| | | | |
|---|---|---|---|
| 3,080,723 | 3/1963 | Price | 62/259.3 X |
| 3,085,405 | 4/1963 | Frantti | 62/3.5 |
| 3,283,520 | 11/1966 | Donohue et al. | 62/261 X |
| 4,748,829 | 6/1988 | Whiteman | 62/325 |

*Primary Examiner*—Lloyd L. King

[57] ABSTRACT

An electrically powered heater/cooler is coupled to a pair of air heat exchangers to warm one above ambient temperature and to cool the other below ambient. Input ducts to the heat exchangers are connected to a common duct attached to a fan supplying ambient air to both heat exchangers. The warm and cool air output ducts from the heat exchangers are connected to input ducts on opposing sides of a plenum which includes exit ducting on opposing sides. A vane assembly is movably supported within the plenum and is positioned to control the access of the cool and warm sides to the output ducts from the plenum. One output duct from the plenum connects a comfort conditioning air stream to ducting connected to a distributor mounted to direct the stream to the head and neck regions of an individual. The other output duct connects rejected air to the ambient environment.

1 Claim, 2 Drawing Sheets

PERSONAL COMFORT CONDITIONER

FIELD OF THE INVENTION

The present invention relates to air conditioning and, more particularly, is concerned with an electrical appliance for directly providing personal thermal comfort for an individual.

BACKGROUND OF THE INVENTION

Air conditioners are not available to provide micro-environmental control. Nor are means available to provide local comfort conditioning air streams either above or below ambient temperature easily selectable by the user.

Varied means have been proposed to provide localized comfort to an individual user by supplying cooled or heated air, but not both, to porous structures incorporated in varied ways into blankets, mattresses, seat cushions, and chair backs. Investigators have found that selective cooling or heating of the head and neck region of an individual engaged in sedentary activities reduces the feelings of thermal stress, readily bringing the human system back to neutral responses, and involving rather minor, 100 watt, heat load variations.

It is an object of this invention to provide an electrically powered system which desirably is small, compact, portable and relatively energy efficient while supplying controlled temperature, comfort conditioning air streams to the head and neck region of the user. The basic units are readily incorporated as components in designing furniture for the home, office or factory. The system supplements rather than supplants existing primary heating and/or cooling systems.

SUMMARY OF THE INVENTION

An apparatus has means for converting an ambient air stream into a cool and a warm air stream. Connecting to this apparatus is a means for partially mixing the warm and cool streams to form a comfort conditioning air stream and a rejected air stream, a means connected to this second means for distributing the comfort conditioning stream to the head and neck regions of the user, and a means connected to the second means for distributing the rejected air into the ambient environment.

The apparatus includes a pair of heat exchangers which are connected to an electrically powered heater/cooler transferring heat from one heat exchanger to the other, creating thereby heat exchanger surfaces which are above and below ambient temperature. The heat exchangers on the air input side are connected by ducting to a fan assembly supplying moving air to the heat exchangers' separately warmed and cooled chambers. The exiting warm and cool air streams enter ductings connected to opposite sides of a plenum. The plenum exit ducting defines two output air streams, one the conditioned air and the other rejected air. Within the plenum is located a movable valve assembly which proportions the access of warm and cool sides of the plenum to the exiting comfort conditioned air ducting, thereby controlling its temperature. The comfort conditioned air ducting terminates at a distributor located near the head and neck region of the individual user. The other exit ducting from the plenum connects to the rejected air ducting which terminates at the rejected air distributor to the ambient remotely from the user.

In a preferred embodiment the means to warm and cool the heat exchangers are heater/coolers of a solid state thermoelectric (Peltier effect) module form appropriately mounted between the warm and cool heat exchangers. This provides a quiet, solid state, long-lived, high reliability design for the warn and cool air supply system.

In the system delivers the comfort conditioning air is delivered through ducting to appropriately designed distributors directed towards the head and neck region of the user. The rejected air ducting redisperses this air into the local environment in a direction not disturbing to the user. The relatively small heat loads involved in personal comfort conditioning of users under sedentary circumstances do not significantly alter the room environmental conditions.

DETAILED DESCRIPTION OF THE INVENTION

Figure 1:
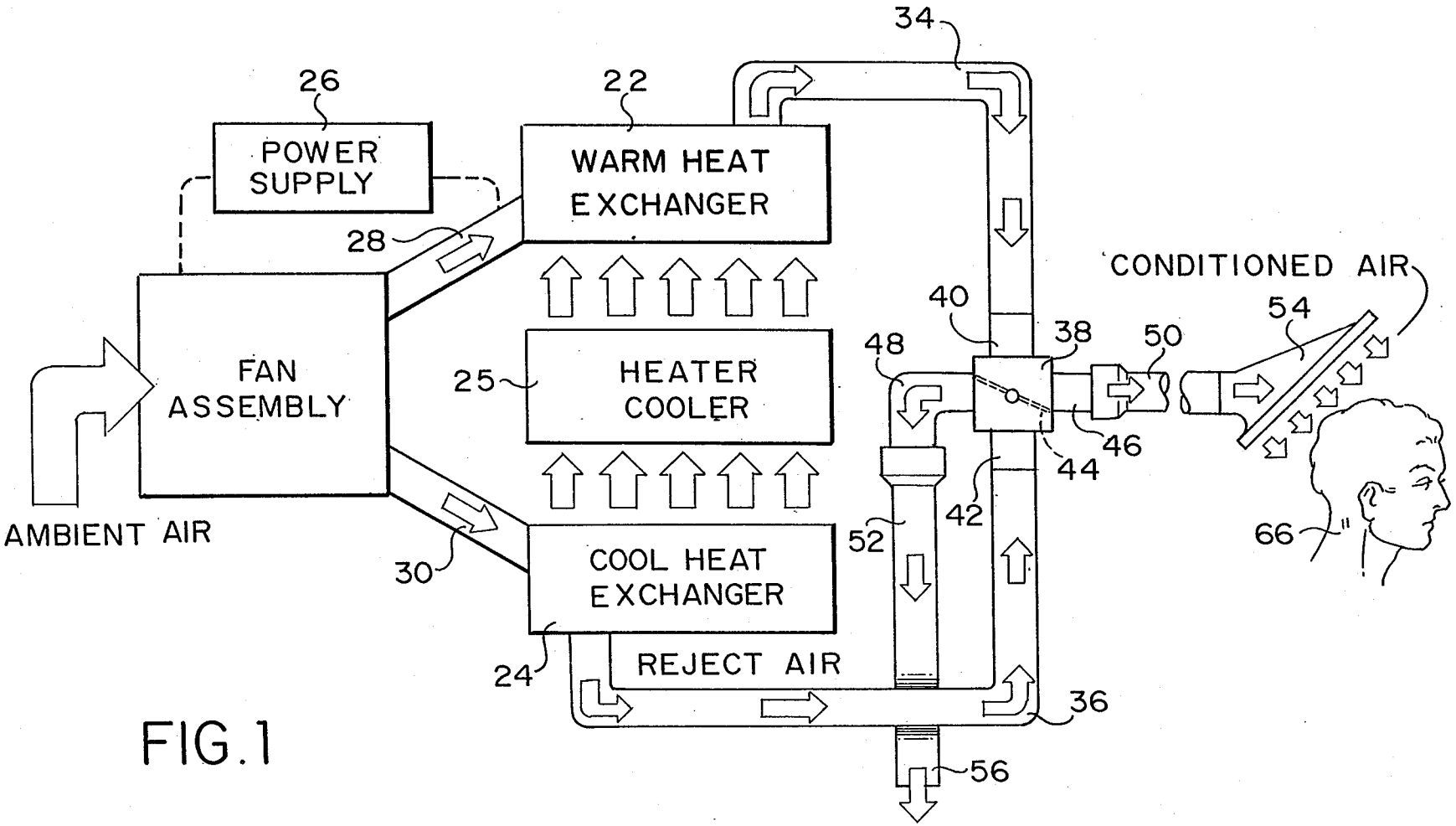
FIG. 1 is a schematic drawing of a conditioned air source for the personal comfort conditioner in accordance with the present invention.

As shown in FIG. 1, the system includes a pair of heat exchanger chambers 22, 24 and a heater/cooler 25 connected to a power supply 26 for simultaneously heating and cooling the heat exchanger chambers 22, 24.

The input ends of the heat exchanger chambers 22, 24 are connected to a pair of ambient air input ducts 28, 30 which are connected at their opposite ends to common ducting interfacing with the exit face of a fan assembly 32 which supplies moving air to the system. The fan assembly 32 is electrically connected to the power supply 26.

The heat exchanger chambers 22, 24 are connected to a pair of warm and cool air ducts 34, 36 which are connected to a pair of input ducts 40, 42 attached to opposing surfaces of a plenum 38. An externally adjustable, movable baffle 44 is pivotally supported centrally within the plenum 38. A pair of output ducts 46, 48 from the plenum 38 have portions each disposed substantially at right angles to the input ducting 40, 42 with the position of the movable baffle 44 position determining the proportional warm and cool ducting access to the output ducting 46, 48. The output duct 48 is connected to a conditioned air duct 50 which is terminated by a distributor 54 having a shape appropriate to a user 66 for the personal comfort conditioner. The output air duct 46 is connected to a rejected air duct 52 and terminates at a rejected air distributor 56.

Figure 2:
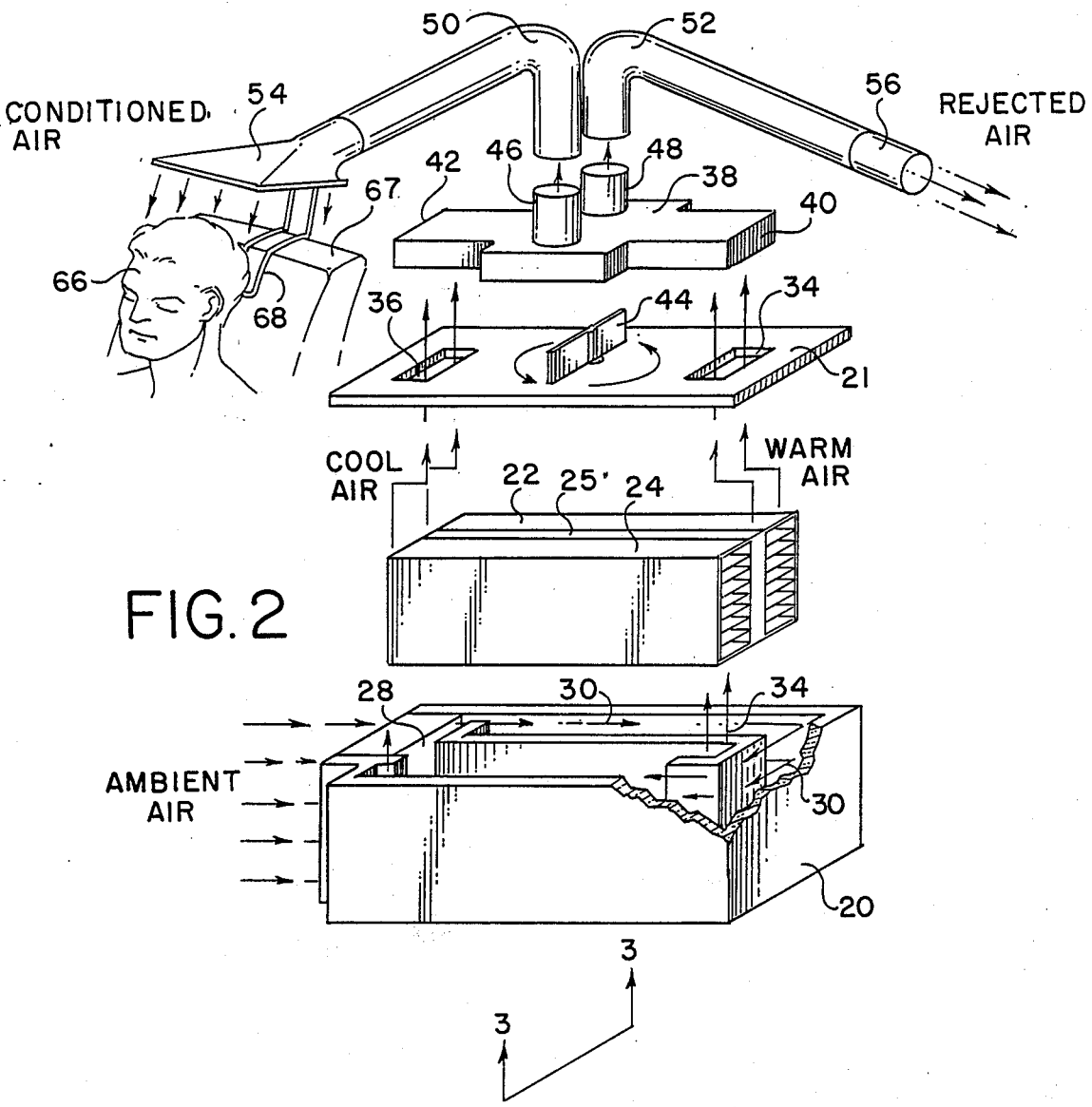
FIG. 2 is an exploded perspective view of the invention using a solid state thermoelectric (Peltier) system as a heater/cooler.
Figure 3:
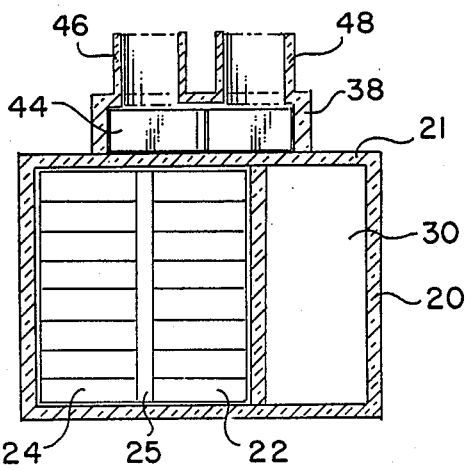
FIG. 3 is a cross-sectional view taken along line 3—3 of FIG. 2.

As shown in FIGS. 2 and 3, a foam plastic, thermally insulative frame 20 supports the heat exchanger chambers 22, 24 which are connected to the heater/cooler 25 having electrically powered thermoelectric modules appropriately mounted between the heat exchangers so as to warm the heat exchanger chamber 22 and to cool the heat exchanger chamber 24. The input sides of the heat exchanger chambers 22, 24 are connected to the air input ducts 28, 30 of the frame 20 to produce a countercurrent direction of air flow in the heat exchangers. The air input ducts 28, 30 diverge from the output interface of a fan assembly 32 providing the input air streams. Connected to the heat exchanger chambers 22, 24 are the output ducts 34, 36 within the frame 20 and pass through a cover 21 attached to the frame 20. The output ducts 34, 36 are connected to the warm and cool air input ducts 40, 42 connected to opposite sides of the plenum 38. The input ducts 40 and 42 and the plenum assembly are attached to the frame cover 21. The externally adjustable baffle 44 is pivotally mounted centrally in the plenum 38.

The output ducts 46, 48 from the plenum 38 have portions each disposed substantially at right angles to the input ducts 40, 42 with position of the movable baffle proportioning the warm and cool air ducts access to the output ducts.

The plenum exit duct 46 connects to the conditioned air ducting 50 terminating at the conditioned air distributor 54 directed towards the head and neck regions of the user 66. The distributor 54 is attached to the furniture back 67 through hook and eye fastener tapes 68 of the Velcro (TM) form. The plenum exit duct 48 is connected to the rejected air duct 52 terminating at the rejected air distributor 56 to the ambient air.

Ambient air driven by fan assembly 32 passes through the heat exchanger chambers 22, 24 which respectively are warmer and cooler than the ambient air due to the Peltier effect thereon of the heater/cooler 25. The warmer air in the duct 34 is mixed with the cooler air from the duct 36 in a selected proportion as determined by the baffle 44, the desired portion of which is directed to the user 66 while the excess is rejected by being dumped to the atmosphere remotely from the input to the fan assembly 32.

The conditioned air distributors 54 are adaptable to provide comfort conditioning to the individual under varied conditions of kneeling, sitting, standing, or reclining.

Although a preferred embodiment of the conditioned air generator for the personal comfort conditioner has been presented, it is evident that many changes are possible while yet remaining within the principles of the present invention.

I claim:

1. A personal comfort conditioner system for heating or cooling a single individual comprising:

(a) a frame;

(b) a fan assembly connected to said frame;

(c) an ambient air heat exchanger assembly having separate heating and cooling chambers supported by said frame;

(d) an air input ducting assembly interconnecting said fan assembly with both of said chambers to provide ambient room air to both of said chambers;

(e) an electrically powered thermoelectric heat pump assembly attached to said chambers for simultaneously separately heating and cooling room air in said chambers;

(f) a plenum connected at opposite sides to said chambers for receiving flow of heated and cooled room air therefrom;

(g) a single movable baffle disposed in said plenum between said flow of heated and cooled air to proportion the relative magnitudes of said flows;

(h) a comfort conditioning distributor having means for directing conditioned air to a single individual; and (i) a first output ducting assembly interconnecting said plenum at one side of said baffle to said air distributor, and a second output ducting assembly interconnecting said plenum at the opposite side of said baffle to the room ambient remotely from the individual.

* * * * *